US006654682B2

(12) United States Patent
Kane et al.

(10) Patent No.: US 6,654,682 B2
(45) Date of Patent: Nov. 25, 2003

(54) TRANSIT PLANNING SYSTEM

(75) Inventors: Roland J. Kane, Palo, IA (US); David C. Krueger, Cedar Rapids, IA (US); Chad Reed, Marion, IA (US); Gareth R. Strope, Cedar Rapids, IA (US); Richard A. Stanek, Cedar Rapids, IA (US)

(73) Assignee: Siemens Transportation Systems, Inc., Sacramento, CA (US)

( * ) Notice: Subject to any disclaimer, the term of this patent is extended or adjusted under 35 U.S.C. 154(b) by 22 days.

(21) Appl. No.: 09/758,692

(22) Filed: Jan. 11, 2001

(65) Prior Publication Data

US 2001/0049581 A1 Dec. 6, 2001

Related U.S. Application Data

(60) Provisional application No. 60/191,677, filed on Mar. 23, 2000.

(51) Int. Cl.[7] ..... F41G 7/34

(52) U.S. Cl. ..... 701/202; 340/988

(58) Field of Search ..... 701/202, 201, 701/206, 207, 209; 340/988

(56) References Cited

U.S. PATENT DOCUMENTS

| | | | | |
|---|---|---|---|---|
| 4,630,209 A | | 12/1986 | Saito et al. | |
| 5,046,011 A | * | 9/1991 | Kakihara et al. | 340/990 |
| 5,412,573 A | | 5/1995 | Barnea et al. | |
| 5,463,554 A | * | 10/1995 | Araki et al. | 340/995 |
| 5,911,773 A | * | 6/1999 | Mutsuga et al. | 340/990 |
| 5,929,608 A | * | 7/1999 | Ibaraki et al. | 290/11 |
| 5,953,722 A | | 9/1999 | Lampert et al. | |
| 5,977,885 A | * | 11/1999 | Watanabe | 340/988 |
| 5,987,375 A | * | 11/1999 | Tamai | 340/990 |
| 6,018,697 A | * | 1/2000 | Morimoto et al. | 340/988 |
| 6,047,235 A | * | 4/2000 | Hiyokawa et al. | 340/988 |
| 6,061,628 A | * | 5/2000 | Hayashi et al. | 340/990 |
| 6,064,941 A | * | 5/2000 | Nimura et al. | 340/988 |
| 6,076,041 A | * | 6/2000 | Watanabe | 340/988 |
| 6,088,649 A | * | 7/2000 | Kadaba et al. | 345/816 |
| 6,088,652 A | * | 7/2000 | Abe | 340/995 |
| 6,101,443 A | * | 8/2000 | Kato et al. | 340/995 |
| 6,108,604 A | * | 8/2000 | Fukaya et al. | 340/995 |
| 6,124,810 A | * | 9/2000 | Segal et al. | 340/441 |
| 6,124,826 A | * | 9/2000 | Garthwaite et al. | 340/995 |
| 6,169,956 B1 | * | 1/2001 | Morimoto et al. | 701/209 |
| 6,175,803 B1 | * | 1/2001 | Chowanic et al. | 340/988 |
| 6,192,312 B1 | * | 2/2001 | Hummelsheim | 340/988 |
| 6,192,314 B1 | * | 2/2001 | Khavakh et al. | 701/209 |
| 6,208,934 B1 | * | 3/2001 | Bechtolsheim et al. | 340/988 |
| 6,226,590 B1 | * | 5/2001 | Fukaya et al. | 701/209 |
| 6,243,646 B1 | * | 6/2001 | Ozaki et al. | 701/201 |
| 6,252,544 B1 | * | 6/2001 | Hoffberg | 342/357.06 |
| 6,266,613 B1 | * | 7/2001 | Nimura et al. | 340/990 |
| 6,269,303 B1 | * | 7/2001 | Watanabe et al. | 340/988 |
| 6,278,939 B1 | * | 8/2001 | Robare et al. | 342/357.01 |
| 6,292,745 B1 | * | 9/2001 | Robare et al. | 340/988 |
| 6,298,303 B1 | * | 10/2001 | Khavakh et al. | 701/209 |
| 6,317,683 B1 | * | 11/2001 | Ciprian et al. | 701/118 |
| 6,317,686 B1 | * | 11/2001 | Ran | 701/117 |
| 6,321,158 B1 | * | 11/2001 | DeLorme et al. | 340/995 |
| 6,366,851 B1 | * | 4/2002 | Chojnacki et al. | 701/208 |
| 6,374,176 B1 | * | 4/2002 | Schmier et al. | 701/200 |

FOREIGN PATENT DOCUMENTS

| | | |
|---|---|---|
| EP | 1030167 | 8/2000 |

* cited by examiner

*Primary Examiner*—William A Cuchlinski, Jr.
*Assistant Examiner*—Olga Hernandez

(57) ABSTRACT

An off-line transit planning and management system is disclosed. The off-line transit planning and management system is to be integrated into an on-line transit and management planning system. The process disclosed includes logging timepoints and generating route, pattern, block, and schedule information therefrom to be supplied to a database that is connected to a real-time transit management system.

24 Claims, 2 Drawing Sheets

TRANSIT PLANNING SYSTEM

REFERENCE TO RELATED APPLICATIONS

This application claims the benefit of U.S. Provisional Patent Application No. 60/191,677, filed on Mar. 23, 2000.

FIELD OF THE INVENTION

The present invention relates to management solutions for the transit industry. More specifically, the present invention relates to a system for managing all off-line transit planning. The planning includes customer schedules, bus routes, bus blocks, vehicle assignments, and driver assignments. The system also provides outputs of necessary information for use by an on-line (real-time) transit management system.

BACKGROUND OF THE INVENTION

Transit authorities have a variety of off-line planning needs. These include customer schedules and bus routes, creating and organizing bus blocks, making vehicle and driver assignments, and providing the results of off-line planning to an on-line system for real-time transit fleet management. Transit authorities may include mass transit systems such as bus and train lines as well as delivery vehicles, and the like.

Customer schedules refer to the timepoint grid listings that are traditionally presented to a transit user in paper or electronic form. The points shown on a schedule with a corresponding time are called timepoints. Customer schedules are delineated by bus routes, which are graphical representations of the path a bus follows to meet the timepoint schedule. The bus routes run between a series of timepoints.

Transit vehicles (such as buses) do not necessarily move on bus routes that the transit user sees. For example, a bus may cover one part of a bus route and then switch to cover another bus route. The switch may occur at a common point between the bus routes or by using an interline segment, that is a segment between two points on different bus routes. The physical path that a bus follows when performing work is a pattern. Often, a bus will repeat a few patterns throughout the work day. A pattern done by a bus at a specific time of day is a trip. All the trips a bus does during a day taken together form a bus block. In other words, the entire work that one bus does all day is a block.

Every block done on a particular day requires a vehicle assignment. Vehicle assignments may change from day to day depending on vehicle availability and other factors. All blocks also require driver assignments. The work of a driver for an entire day is called a run. Therefore, a run may correspond to all the work for one block, or only part of a block. However, every run done on a particular day requires a driver assignment. Driver assignments are traditionally changed on a quarterly basis.

After off-line planning is done, an on-line management system uses Global Positioning System (GPS) tracking to provide vehicle management. Thus, an off-line system must provide for geoencoding (that provides an indication of latitude and longitude) of all necessary data. Geoencoding is done at the point level using a geoencoded map.

A variety of systems exist for providing transit off-line planning. No current system covers all needs, including timepoint logging, segment building, route building, pattern building, block building, and scheduling. Multiple systems may be connected to provide a complete solution, however multiple systems are difficult to join, hard to maintain, and are often impossible to connect with an on-line system. Furthermore, the amount of data involved in off-line planning suggests a large advantage to having a single complete system. For example, a typical medium size transit authority deals with 75–100 timepoints, 10–20 routes, 30–50 blocks, 50–100 vehicles, and 75–100 drivers. All the data associated with the transit authority needs to be organized and related with geoencoding.

A particular implementation of off-line transit planning includes the logging of timepoints by traversing the intended route segments and logging each timepoint by hand on a piece of paper and determining position information by using a hand-held GPS device. The logged information is then input (keyed) into a computer database.

Accordingly, it would be advantageous to provide a complete transit planning system that implements all off-line planning needs in a single package. It would also be advantageous to provide a system that provides all the necessary functionality of an off-line planning system from geoencoding of spatial data through route and block creation and vehicle/driver assignments. Further, it would be advantageous to provide an off-line transit planning system that interfaces with an on-line complete management system. Further still, it would be advantageous to provide a software product that may be loaded onto a personal computer or laptop computer with an attached GPS receiver for geoencoding that provides at least all of the data collection necessary for off-line transit planning.

SUMMARY OF THE INVENTION

An exemplary embodiment of the invention relates to a method of creating a navigation database. The method includes generating a navigation point, generating a segment between two navigation points, generating a path segment from a group of path segments, and generating a path from a list of path segments. The method further includes storing at least one of the position, the navigation point, the segment, the path segment, and the path in a memory device.

Another exemplary embodiment of the invention relates to a method of creating a transit schedule. The method includes generating a transit point, generating a street segment between two transit points, generating a route segment from a group of street segments, and generating a route from a group of route segments. The method further includes storing at least one of the transit point, the street segment, the route segment, and the route in a memory device.

Yet another exemplary embodiment of the invention relates to a scheduling system. The scheduling system includes a position signal receiver that receives a position signal. The scheduling system further includes an information processing unit coupled to the position signal receiver, the information processing unit including a memory, a storage device, and a processor. The information processing unit is programmed to receive position data from the position signal receiver, to receive corresponding position data, and to generate at least one of navigation points, segments, path segments, and paths.

BRIEF DESCRIPTION OF THE DRAWINGS

The invention will hereafter be described with reference to the accompanying drawings, wherein like reference numerals denote like elements in the various drawings, and.

DETAILED DESCRIPTION OF THE PREFERRED EMBODIMENT

Figure 1:
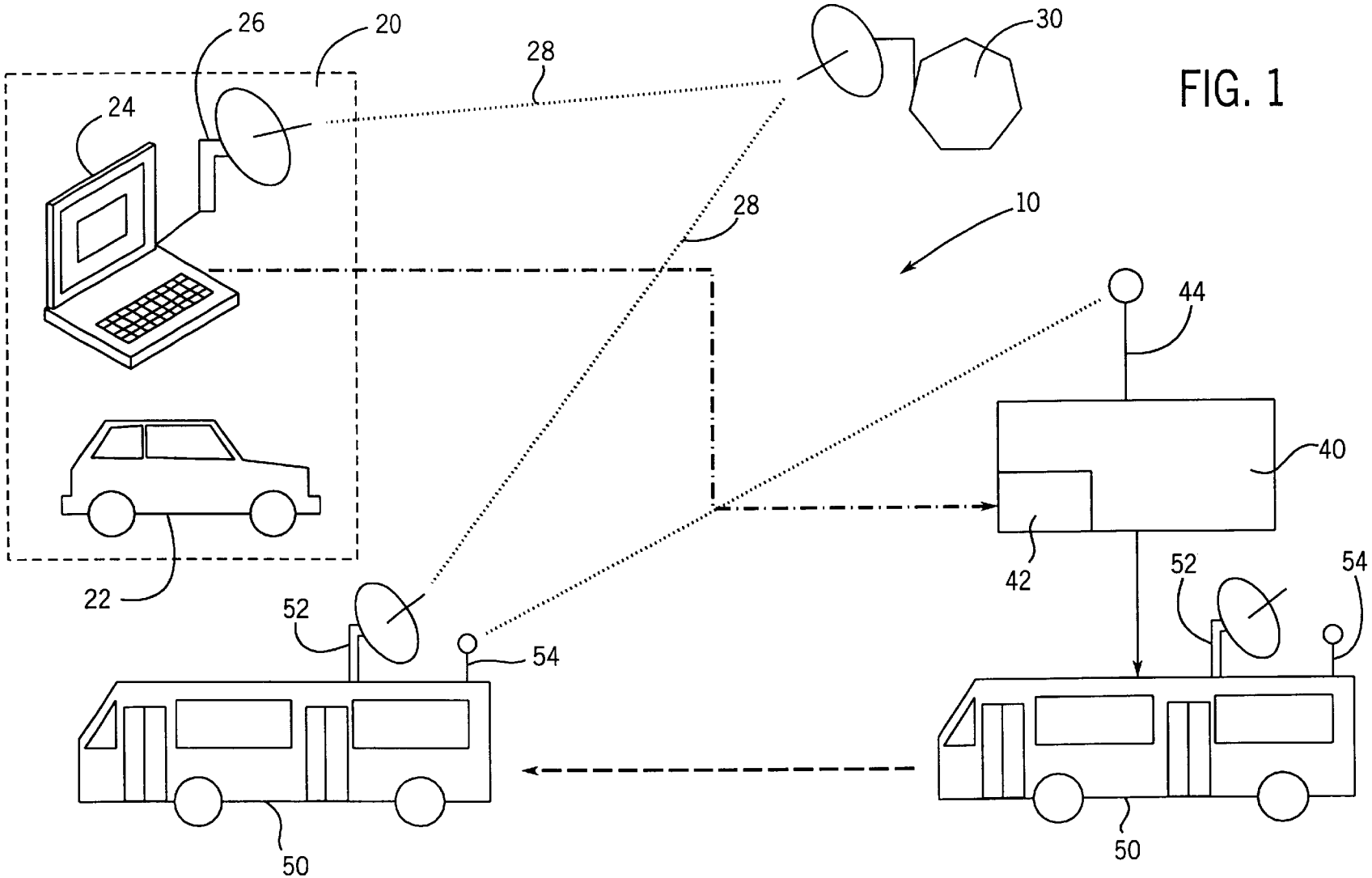
FIG. 1 is a diagrammatic view of a real-time and off-line transit management and planning system.

Referring to FIG. 1 a transit management system 10 is depicted. Transit management system 10 includes an off-line transit planning system 20, a position signal source 30, a dispatch computer 40, and a transit fleet 50.

In operation, off-line transit planning system 20 is designed to geoencode spatial data. Off-line transit planning system 20 includes a vehicle 22 having an on-board computer, such as a laptop computer 24 and an on-board position signal receiver such as GPS receiver 26 connected thereto. GPS receiver 26 is configured to receive a position signal 28 from a position signal source 30, such as a GPS satellite. Off-line transit planning system 20 is used to log, or geoencode, spatial data in the real world. In an exemplary embodiment of the invention, the system has a graphical interface loaded on laptop computer 24 having a geoencoded map of the area of interest. Off-line transit planning system 20 provides a method of logging particular points and automatic logging of paths. Off-line transit planning system 20 further displays points and paths on the map in real-time. As vehicle 22 is driven around the area of interest, points of interest are logged. These points of interest include timepoints, enunciator points, transfer points, and any desired stopping points, such as bus stops. Once a number of relevant timepoints are logged, a bus route can be generated automatically.

Every connection between two timepoints that are logged is defined as a route segment. The route segments are connected together automatically.

In one embodiment of the invention, vehicle 22 is driven around potential bus routes. As vehicle 22 is driven, timepoints are logged on laptop 24. Each timepoint logged includes a latitude and longitude derived from position signal 28 and received by GPS receiver 26. In an exemplary embodiment, off-line transit planning system 20 also allows the adding of timepoints and parts of or entire bus routes using a standard computer with a keyboard and mouse, without a GPS receiver, on a non-mobile computer. Bus routes may be generated automatically while logging is occurring (on laptop computer 24) or bus routes may be generated after the logging is completed (on dispatch computer 40 or any other suitable information processing system). As explained above, patterns consist of route segments, so the user selects and adds route segments graphically to build a pattern. A pattern itself may contain route segments for more than one route. System 10 is configured to build a pattern through a graphic interface (overlaid with an area map) by choosing through a user interface portions of bus routes to add to a pattern. This process is referred to as pattern building.

In an exemplary embodiment, transit management system 10 also provides for building of blocks through the graphical selection of patterns and provides the ability to enter starting and ending times for a block. As discussed earlier, a block is a repetition of one or more patterns, so the selection of a pattern or patterns and the number of repetitions of each pattern constitutes block creation. Off-line transit planning system 20 also allows for association of a service type (for example, weekend service, rush hour service, peak/off-peak service, holiday service, seasonal service, special event service, and the like) with each block. After blocks have been generated, all the blocks taken together constitute a schedule.

Off-line transit planning system 10 further provides vehicle and driver assignments. As explained earlier vehicle and driver assignments are made to runs, that is the work that a driver does during one day. A driver's run may involve more than one block. Therefore, all the runs taken together encompass all of the blocks. In an exemplary embodiment, the vehicle and driver assignments can be saved by day of the week to make exporting them to an on-line system simpler. Referring again to FIG. 1, in an exemplary embodiment, after all of the timepoints have been logged, the associated data is stored in a database on laptop computer 24. The laptop database may be downloaded into a database 42 on database 42 on dispatch computer 40. It should be noted that block building vehicle and driver assignments, pattern building, and bus route building all may be accomplished either directly on laptop computer 24, directly on dispatch computer 40, directly on another suitable information processor, or any combination thereof. Dispatch computer 40 is used to download scheduling information to fleet 50. Fleet 50 may include a fleet of buses, trucks, delivery vehicles, vans, any combination thereof, or any other system requiring scheduling and route planning. In an exemplary embodiment, fleet 50 is a fleet of mass transit buses. Scheduling information is downloaded into each bus. Each bus further includes a GPS receiver 52 and an RF or UHF transmitter and receiver 54. Alternatively, transmitter and receiver 54 may transmit and/or receive on any number of electromagnetic frequency bands.

An information processor is installed on each bus 50, the information processor being coupled to GPS receiver 52 and transmitter 54. In operation, as the bus traverses a route, bus 50 receives position signals 28 from position signal source 30, the position of bus 50 may then be communicated to dispatch computer 40 via transmitter 54. Dispatch computer 40 includes a receiver/transmitter 44 that receives incoming signals from buses 50. As dispatch computer 40 receives information from fleet 50, the information is processed and used in fleet management. Furthermore, dispatch computer 40 and receiver/transmitter 44 may be used to transmit information to potential passengers regarding the present position of each bus.

Figure 2:
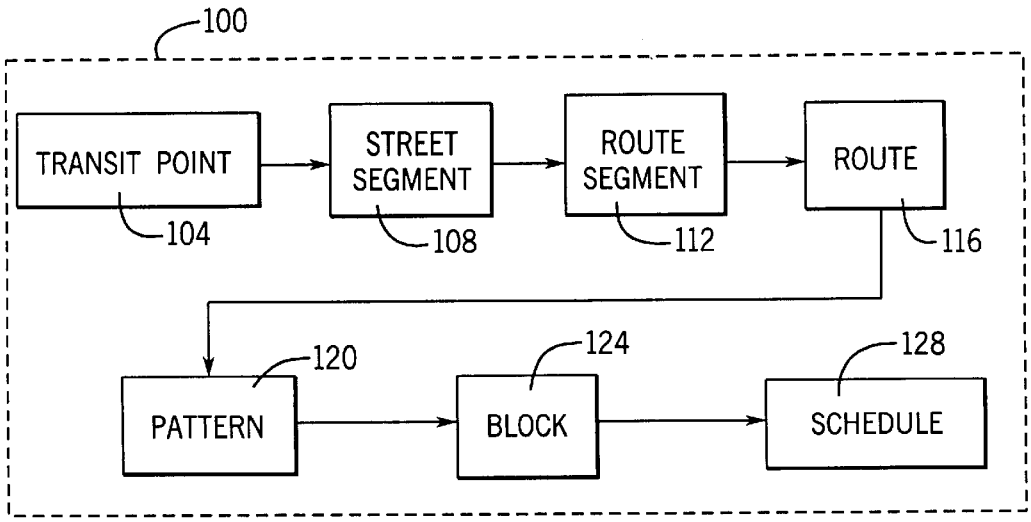
FIG. 2 is a block diagram of the off-line transit planning system.

Referring now to FIG. 2, a block diagram of planning system 100, as applied to a mass transit system, is depicted. Planning system 100 may be loaded as software onto laptop computer 24 to be portable for timepoint logging. In an exemplary embodiment, planning system 100 is integrated into a single software package or a single integrated computer program, such that a number of individual programs do not have to be coordinated together to deliver the same results as system 100.

In a transit domain, each timepoint may be termed a transit point 104. Transit point 104 may include, among other data, any combination of an ID number, a latitude, a longitude, an altitude, a position source, a datum, an estimated horizontal error (EHE), an estimated positional error (EPE), a short name, a long name or description, an attribute set (possibly supplying the type of location, stop, point of interest, etc.) a departure radius, an arrival radius, a list of transit indices, and a layover time. Any combination of this information may be logged at each transit point, by issuing a command to laptop computer 24 to log the point, and stored in database 42.

As discussed earlier, street segments 108 may be generated from transit points. Street segments 108 may include, among other data, an id number, a start transit point pointer, and an end transit point pointer. The start and end transit point pointers define the street segment in terms of the logged transit points.

Once street segments have been generated, route segments 112 may be generated. Route segments may include, among other data, any combination of an ID number, a start timepoint pointer, an end timepoint pointer, a list of street segments, a direction, a distance (computed or user entered), a list of transit indices, an average speed, a run time, and an early arrival permitted flag. The start and end timepoint pointers, and the list of street segments define the route segment.

Once the route segments have been generated, a route 116 may be generated. Route 116 may include, among other data, any combination of an ID number, a name, a description, a route index, and a list of route segments. The list of route segments defines the route.

Once the routes have been generated, it is often useful, but not necessary, to identify a group of route segments that will be repeated in the same order multiple times within a block. A group such as this is called a pattern 120. Any single block may contain several patterns 120. Pattern 120 may include, among other data, an id number, a direction, and a list of route segments with a particular route. Thus, pattern 120 is defined by the list of route segments. Once patterns 120 have been generated, a block 124 may be generated. Block 124 may include, among other data, an ID number, a list of patterns, and the number of repetitions of each pattern, a name, a start time, an end time, and service. The list of patterns and the number of repetitions of each pattern defines a block.

Finally, once a number of blocks have been generated, a schedule 128 may be generated. Schedule 128 includes, among other data, a list of blocks and is defined by the list of blocks.

All of the information generated by system 100 may be stored in a database 42. The generation of data may be accomplished with the software running on laptop computer 24 or alternatively on dispatch computer 40. Once database 42 has been created, a mobile display terminal (MDT) file may be generated. (Database 42 may be stored on laptop computer 24, dispatch computer 40, or any other processing or storage unit.) The MDT files are files that are actually loaded onto the vehicle, such as buses 50 and into the information processors on buses 50, the MDT files are used and referenced by information processors on buses 50 as buses 50 traverse their routes.

A particular advantage of the use of an integrated computer program and system for creating a navigation database, a transit schedule, and/or an MDT file, is that installation of a transit tracking and scheduling system in a municipality not previously serviced is facilitated and simplified. When a municipality not previously serviced is being set up, system 10 enables the ability to automatically generate an MDT file. Further, the use of system 10 allows the ability to easily provide route changes to the MDT files in the case of new or changed routes, changed conditions (such as, but not limited to, detours, temporary route changes, road conditions), service changes, and the like. Further still, the use of system 10 allows the potential to update the MDT file directly by getting timepoint information from transit vehicles 50 which are running the route.

In a particular exemplary embodiment of system 10, planning system 20 is not required to provide logging. Logging may be provided by buses 50 that are already running the routes and are then able to communicate the logging information directly to dispatch computer 40 that may be operating in a "learning" mode to construct database 42.

Figure 3:
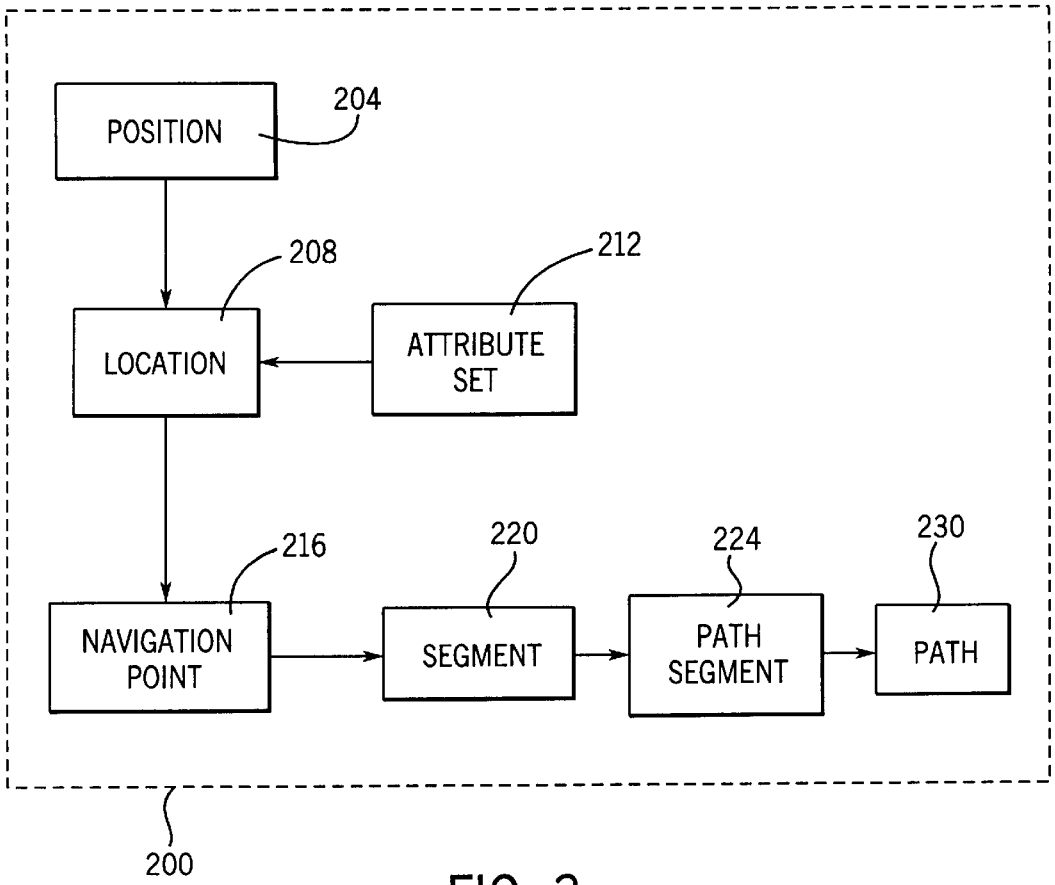
FIG. 3 is a block diagram of a generic off-line planning system.

Referring now to FIG. 3, an alternative embodiment is depicted, by the block diagram of a planning system 200. Planning system 200 may be applied generically to any number of planning situations in which positions and timepoints need to be logged and paths need to be generated therefrom.

Planning system 200 includes logging positions 204. Each position may include, among other data, a coordinate position, such as a latitude or a longitude and altitude, an id number, a source (such as a GPS or a user), a datum, EHE, and EPE. Once a position 204 has been logged, a number of attributes may be attached thereto. For example, a location 208 attribute may be attached to each position 204, location attribute 208 may include an ID number a short name, a long name or description, and an attribute set 212. Attribute set 212 may include an id number, a departure radius, and an arrival radius. The departure and arrival radii provides a level of tolerance such that when a vehicle, or other entity enters the arrival radius or is within the departure radius, the vehicle or entity is defined to be at that navigation point. For example, the arrival radius for a "park and ride" bus stop may be defined to encompass the entire "park and ride" facility. Thus, when the bus enters the "park and ride" facility, the bus is defined as being at the corresponding navigation point.

Once navigation points are logged, segments 220 may be derived therefrom. Each segment may include, among other data, an id number, a starting navigation point pointer, and an ending navigation point pointer. Each segment is defined by the starting navigation and ending navigation points.

Once a number of segments are generated, a path segment 224 may be generated. Each path segment may include, among other data, an id number, a start waypoint pointer, an end waypoint pointer, and a list of segments. Each path segment 224 is defined by the starting and ending waypoint pointers and the list of segments.

After a number of path segments have been defined, a path 230 may be generated. Path 230 includes an id number and is defined by a list of path segments.

Once planning system 200 has defined a number of paths 230, the path data can be manipulated to generate any of a number of patterns, blocks, and schedules, similar to those described relating to transit planning system 100.

It is understood that while the detailed drawings and examples given describe exemplary embodiments, they are for the purposes of illustration only. The method and apparatus described is not limited to the precise details and conditions disclosed. For example, it is not limited to the specific inputs stated, to the specific data collection, and the entry devices used. Various changes may be made to the details disclosed without departing from the scope of the invention, which is defined by the following claims.

What is claimed is:

1. A method of creating a navigation database, the method comprising:

generating a first navigation point while situated at a first location;

storing the first navigation point in the navigation database;

moving from a first location to a second location;

generating a second navigation point while situated at a second location;

storing the second navigation point in the navigation database;

generating a segment between the first and the second navigation points;

storing the segment with a group of segments in the navigation database;

generating a path segment from the group of segments;

storing the path segment with a list of path segments in the navigating database; and generating a path from the list of path segments, wherein the method is carried out by a single integrated computer program.

2. The method of creating a navigation database according to claim 1 wherein the generating a navigation point step comprises:

obtaining a position from a positioning signal.

3. The method of creating a navigation database according to claim 2 wherein the generating a navigation point step further comprises:

providing a set of attributes corresponding to the position to generate a navigation point.

4. The method of creating a navigation database according to claim 3 wherein the attributes include at least one of a descriptive name, a departure radius, and an arrival radius.

5. The method of creating a navigation database according to claim 1 wherein the segment includes a start navigation point pointer and an end navigation point pointer.

6. The method of creating a navigation database according to claim 1 wherein the path segment includes a start waypoint pointer, an end waypoint pointer, and a list of segments.

7. A method of creating a transit schedule, the method comprising:

generating a first transit point while situated at a first location;

generating a second transit point while situated at a second location;

generating a street segment between the first and second transit points;

generating a route segment from a group of street segments;

generating a route from a group of route segments; and storing at least one of the transit point, the street segment, the route segment, and the route in a transit schedule database;

wherein the method is carried out substantially by a single integrated computer program.

8. The method of creating a transit schedule according to claim 7 further comprising:

generating a pattern from a group of route segments.

9. The method of creating a transit schedule according to claim 8 further comprising:

generating a block from a group of patterns.

10. The method of creating a transit schedule according to claim 9 further comprising:

generating a schedule from a group of blocks.

11. The method of creating a transit schedule according to claim 10 further comprising:

storing at least one of the pattern, the block, and the schedule in the transit schedule database.

12. The method of creating a transit schedule according to claim 9 wherein the generating a transit point step comprises:

receiving a position signal from a position signal source.

13. The method of producing a transit schedule according to claim 12 further comprising:

generating a mobile display terminal (MDT) file from the transit schedule database.

14. The method of creating a transit schedule according to claim 12 wherein the position signal source is a global positioning system (GPS) satellite and the position signal is a global positioning system (GPS) signal.

15. A scheduling system comprising a position signal receiver to receive a position signal;

an information processing unit coupled to the position signal receiver, the information processing unit including a memory, a storage device, and a processor;

wherein the information processing unit runs a single integrated program to receive position data from the position signal receiver, to receive corresponding position data, and to generate at least one of navigation points, segments, path segments, and paths and stores at least one of navigation points, segments, path segments, and paths to be used to generate a transit schedule; and the navigation points are transit points, the segments are street segments, the path segments are route segments, and the paths are routes and at least one of the transit points, the street segments, the route segments, and the routes are stored in a database.

16. The scheduling system of claim 15 wherein the information processing unit is a computer.

17. The scheduling system of claim 16 wherein the position signal receiver is a global positioning system (GPS) receiver.

18. The scheduling system of claim 15 wherein the database is downloadable into a dispatch computer.

19. The scheduling system of claim 15 wherein a schedule is generated from the database.

20. The scheduling system of claim 19 wherein the schedule is downloaded to at least one transit computer.

21. The scheduling system of claim 20 wherein the transit computer is coupled to a position signal receiver to receive position signals.

22. The scheduling system of claim 21 wherein the transit computer is coupled to a transmitter to transmit signals to the dispatch computer.

23. The scheduling system of claim 15 wherein the information generated is communicated to a dispatch computer.

24. The scheduling system of claim 23 wherein the dispatch computer operates in a learning mode to generate a database file.

* * * * *